United States Patent [19]

Braun et al.

[11] 4,285,803

[45] Aug. 25, 1981

[54] CATALYTIC SLURRY PROCESS FOR BLACK OIL CONVERSION

[75] Inventors: Richard Braun, Hoffman Estates; Russell W. Johnson, Villa Park; John G. Gatsis, Des Plaines, all of Ill.

[73] Assignee: UOP Inc., Des Plaines, Ill.

[21] Appl. No.: 115,305

[22] Filed: Jan. 24, 1980

[51] Int. Cl.[3] ..... C01G 9/16

[52] U.S. Cl. ..... 208/48 AA; 208/112; 208/251 H

[58] Field of Search ..... 208/112, 48 AA, 108–111, 208/56–61, 251 H, 157–164

[56] References Cited

U.S. PATENT DOCUMENTS

| | | | |
|---|---|---|---|
| 3,567,623 | 3/1971 | Hagney | 208/48 |
| 3,776,835 | 12/1973 | Dvoracek | 208/48 |
| 4,024,051 | 5/1977 | Shell et al. | 208/348 |
| 4,067,799 | 1/1978 | Bearden et al. | 208/112 |
| 4,172,814 | 10/1979 | Moll et al. | 208/108 |
| 4,192,735 | 3/1980 | Aldridge et al. | 208/112 |
| 4,200,518 | 4/1980 | Mulvany | 208/48 |
| 4,214,977 | 7/1980 | Ranganathan et al. | 208/108 |

*Primary Examiner*—Delbert E. Gantz
*Assistant Examiner*—G. E. Schmitkons
*Attorney, Agent, or Firm*—James R. Hoatson, Jr.; John G. Cutts, Jr.; William H. Page, II

[57] ABSTRACT

A solids dispersant comprising an oil-soluble salt is added to catalytic slurry of hydrocarbonaceous charge stock to reduce coke deposits in conversion at temperatures above about 400° F. Dosage is about 0.0001% to 1% of a condensation product of an epihalohydrin and equimolar amount of $C_{12}$–$C_{40}$ alkylamine.

14 Claims, No Drawings

CATALYTIC SLURRY PROCESS FOR BLACK OIL CONVERSION

BACKGROUND OF THE INVENTION

The process described herein is applicable to the conversion of petroleum crude oil residuals having a high metals content and comprising a hydrocarbon-insoluble asphaltene fraction. More specifically, our invention is directed toward a method for effecting a catalytic slurry process, in the presence of hydrogen, in order to convert atmospheric tower bottoms, vacuum column bottoms, crude oil residuals, topped and/or reduced crude oils, coal oil extracts, crude oils extracted from tar sands, shale oil, etc., all of which are commonly referred to in the art as "black oil".

Petroleum crude oils, and particularly the heavy residuals derived therefrom, contain sulfurous compounds in exceedingly large quantites, nitrogenous compounds, high molecular weight organometallic complexes principlally comprising nickel and vanadium as the metallic component and hydrocarbon-insoluble asphaltenic material. The latter is generally found to be complexed with sulfur, and, to a certain extent, with the metallic contaminants. A black oil is generally characterized in petroleum technology as a heavy hydrocarbonaceous material of which more than about 10.0 percent (by volume) boils above a temperature of about 1050° F. (referred to as nondistillables) and which further has a gravity generally less than 20.0 °API. Sulfur concentrations are exceedingly high, most often in the range of about 2.0 to about 6.0 percent by weight. Canradson carbon residual factors exceed 1.0 percent by weight and the concentration of metals can range from as low as about 20 ppm to as high as about 2000 ppm by weight.

The process encompassed by the present invention is particularly directed toward the conversion of those black oils contaminated by large quantities of insoluble asphaltenes and having a high metals content, i.e. containing more than about 150 ppm by weight. Specific examples of the charge stocks to which our invention is adaptable include a vacuum tower bottoms product having a gravity of 7.1 °API and containing 4.1 percent by weight of sulfur and 23.7 percent by weight of heptane-insoluble materials; a "topped" Middle-East crude oil having a gravity of 11.0 °API and containing about 10.1 percent by weight of asphaltenes and 5.2 percent by weight of sulfur; and, a vacuum residuum having a gravity of 8.8 °API, containing 3.0 percent by weight of sulfur and 4300 ppm by weight of nitrogen.

Candor compels recognition of the fact that many slurry-type processes have been proposed. Regardless of the various operating and processing techniques, the principal difficulty resides in the separation of the effluent to provide substantially catalyst-free distillable product, uninterrupted catalyst recirculation and continuous, smooth, unimpeded flow of the reactants and the slurry catalyst through the entire process and particularly in the reaction zone.

The black oil is typically utilized in a slurry catalyst process and is inherently susceptible to the formation of coke when exposed to hydrocarbon conversion temperatures. Our invention affords an improved catalytic slurry process for black oil conversion by reducing the formation of undesirable coke and any other undesirable deposits and thereby improving process stability.

DETAILED DESCRIPTION OF THE INVENTION

A principal object of the present invention is to provide a process for the conversion of hydrocarbonaceous black oils. A corollary object is to convert hydrocarbon-insoluble asphaltenes into hydrocarbon-soluble, lower-boiling normally liquid products.

Another object is to effect removal of sulfurous and nitrogenous compounds through the destructive conversion thereof to hydrocarbons, hydrogen sulfide and ammonia.

A specific object of our invention is to effect the continuous decontamination of asphaltenic black oils by providing a slurry process utilizing a finely-divided solid catalytic component and a solids dispersant.

Therefore, in one embodiment, our invention encompasses a process for the conversion of an asphaltene-containing hydrocarbonaceous charge stock which comprises the steps of: (a) forming a reactive slurry of said charge stock, hydrogen and a finely divided catalyst containing at least one metal component from the metals of Groups, V-B, VI-B and VIII of the Periodic Table; (b) reacting said slurry in a reaction zone at hydrocarbon conversion conditions including a pressure above about 100 psig and a temperature above about 400° F. in contact with a solids dispersant; and, (c) recovering a hydrocarbonaceous product.

Other embodiments of our invention reside in the utilization of particular operating conditions and techniques, concentration of solids dispersant, etc. For example, the hydrocarbon conversion conditions include a temperature from about 400° F. to about 900° F. and a pressure from about 100 psig to about 5000 psig.

These, as well as other objects and embodiments will become apparent from the hereinafter description.

A particular, finely divided, solid catalyst utilized in the present slurry process, is not considered to be essential. However, it must be recognized that the catalytically active metal component of the catalyst necessrily possesses both cracking and hydrogenation activity. Thus, in most applications of the present invention, the catalytically active metallic component will be selected from the metals of Groups V-B, VI-B and VIII of the Periodic Table. Of these, preferred metallic components are vanadium, chromium, iron, cobalt, nickel, niobium, molybdenum, tantalum and tungsten; the noble metals of Group VIII are not generally considered for use in a slurry-type process, particularly in view of economic considerations. Recent investigations and developments in catalytic slurry processing of heavy hydrocarbonaceous charge stock have indicated that the sulfides of the foregoing metals, and particularly those of Group V-B, offer more advantageous results. For this reason, the preferred unsupported catalyst comprises tantalum, niobium and vanadium sulfides, the latter being particularly preferred. In the interest of brevity, the following discussion will be limited to the use of vanadium sulfides as the catalyst employed in the present slurry process.

The vanadium sulfides may be prepared in any convenient manner, the precise method not being essential to the present invention. For example, vanadium pentoxide may be reduced with sulfur dioxide and water to yield a solid hydrate of vanadyl sulfate. The latter is treated with hydrogen sulfide at a temperature of about 300° C. to form vanadium tetrasulfide. Reducing the vanadium tetrasulfide in hydrogen at a temperature about about 300° C. produces the vanadium sulfide slurried into the system.

The concentration of vanadium sulfides slurried with the hydrocarbonaceous material charged to the reaction chamber, is within the range of from about 0.4% to about 10.0% by weight, calculated as the elemental metal. Excessive concentrations do not appear to enhance the results, even with extremely contaminated charge stocks having exceedingly high asphaltene concentrations. Preferred concentrations of vanadium sulfides are within the range of from about 2.0% to about 6.0% by weight, calculated as the metal. It should be noted that vanadium forms a multiplicity of sulfides, some of which are non-stoichiometric. Examples of various sulfides of vanadium include VS, $VS_2$, $V_2S_3$, $VS_4$, $VS_3$, and $V_2S_5$. During the reactions, the vanadium sulfide prepared as hereinabove set forth, is converted to one or more of these forms, or some other form.

Suitable asphaltene-containing hydrocarbonaceous charge stock for use in the instant invention includes petroleum-derived black oil, tar sand extract, primary coal oils and shale oil.

The catalyst may be recovered or separated by a series of filtration or solvent extraction techniques. The solvent may be employed to remove residual, soluble hydrocarbons from the catalyst sludge. Suitable solvents include benzene, toluene, etc.

Hydrogen is an essential reactant in the conversion of asphaltene-containing hydrocarbons and usually present in the reaction zone in an amount from about 1000 to about 150,000 standard cubic feet per barrel of normally liquid hydrocarbon feed.

Another essential component which must be present in the conversion zone is a solids dispersant. Any suitable solids dispersant may be used which is compatible with the conditions encountered in the reaction zone which conditions include a temperature up to about 800° F. Therefore, any component which displays a solids dispersion function and is highly resistant to undesirable degradation may be utilized according to the method of the present invention.

We have discovered that an outstanding solids dispersant for the practice of the present invention is a 50% solution of the product of $C_{18}H_{37}NH(CH_2)_3NH_2$ which has been cross-linked with epichlorohydrin in a xylene solvent.

A broad description of a suitable solids dispersant is an oil-soluble HCl salt of the condensation product, formed at a temperature of from about 20° C. to about 150° C. of equimolar amounts of epichlorohydrin and an alkyl amine having from about 12 to about 40 carbon atoms per molecule, from about 1% to about 20% of the amino nitrogen in said condensation product being neutralized with HCl.

Another suitable solids dispersant is an oil-soluble HCl salt of the condensation product, formed at a temperature of from about 20° C. to about 150° C., of equimolar amounts of epichlorohydrin and tallow amine, from about 1% to about 20% of the amino nitrogen in said condensation product being neutralized with HCl.

Another suitable solids dispersant is an oil-soluble HCl salt of an ester of carboxylic acid containing from about 6 to about 50 carbon atoms per molecule and the condensation product, formed at a temperature of from about 20° C. to about 150° C., of equimolar amounts of epichlorohydrin and an alkyl amine of from about 12 to about 40 carbon atoms per molecule, from about 1% to about 20% of the amino nitrogen in said condensation product being neutralized with HCl and the amount of carboxylic acid being sufficient to esterify from one to all of the hydroxyl groups in the condensation product.

Another suitable solids dispersant is an oil-soluble mixed HCl-alkyl acid phosphate salt of the condensation product, formed at a temperature of from about 20° C. to about 150° C. of equimolar amounts of epichlorohydrin and an alkyl amine of from about 12 to about 40 carbon atoms per molecule, from about 1% to about 20% of the amino nitrogen in said condensation product being neutralized with HCl and the amount of alkyl acid phosphate being at least one mol of phosphate per mol of the condensation product.

Another suitable solids dispersant is an oil-soluble alkyl acid phosphate salt of an ester of a carboxylic acid of from about 6 to about 50 carbon atoms per molecule and the condensation product of from 1 to 2 mols of an epihalohydrin compound with from 1 to 2 mols of an aliphatic amine of from about 12 to about 40 carbon atoms per molecule, the amount of said acid being sufficient to esterify from one to all of the hydroxyl groups in said condensation product and the amount of alkyl acid phosphate being at least one mol of phosphate per mol of the ester.

Yet another suitable solids dispersant is the reaction product formed at a temperature of from about 20° C. to about 150° C. of from 1 to 2 mol proportions of an aliphatic amine compound having at least one hydrogen atom attached to a nitrogen atom, said amine compound consisting of carbon, hydrogen and nitrogen, and having at least 12 and up to about 40 carbon atoms and a straight chain of at least 3 carbon atoms attached to the nitrogen atom, with one mol proportion of an epihalohydrin compound selected from the group consisting of epichlorohydrin, 1,2-epi-4-chlorobutane, 2,3-epi-4-chlorobutane, 1,2-epi-5-chloropentane, 2,3-epi-5-chloropentane and corresponding bromo and iodo compounds, and reacting with an inorganic base to remove halogen.

The solids dispersant is incorporated with the reactants in a concentration which is generally well below about 1% by weight based on the hydrocarbonaceous charge stock and usually in a concentration within the range of from about 0.0001% to about 1% by weight.

The following example is given to illustrate further the improved process of the present invention for the conversion of asphaltene-containing hydrocarbonaceous feed stocks. It is understood that the example is illustrative rather than restrictive. Specific operating conditions, processing techniques, catalyst compositions and the other individual process details are presented for description but it is not intended that the invention be limited to the specific illustration, nor is it intended that a given process be limited to the particulars mentioned.

EXAMPLE

A small scale laborator plant was selected to conduct experiments relating to the conversion of a topped crude oil having the characteristics presented in Table I in a slurry process utilizing a vanadium sulfide catalyst. The experiments were conducted with the hereinabove described topped crude oil containing 4 weight percent vanadium sulfide slurry catalyst, calculated as the metal, in a reaction zone having a 0.3 liquid hourly space velocity, a 5000 standard cubic feet per barrel of hydrogen circulation, a temperature of 790° F. and a pressure of 2000 psig.

The first run was initiated and the plant ran smoothly with very little pressure drop across the reaction zone. After the plant had been on stream for 24 hours, the reaction zone developed a pressure drop of about 300 psig and therefore the run had to be terminated. Inspection of the reaction zone revealed a restriction plug which contained about 12 percent carbon and the remainder vanadium sulfide catalyst.

The second run was performed in the same manner as hereinabove described with the exception that a solids dispersant in an amount of 0.1 weight percent based on the topped crude oil was added prior to introduction into the plant. In this case, the solids dispersant was a solution of polymerized $C_{18}H_{37}NH(CH_2)_3NH_2$ which had been cross-linked with epichlorohydrin. After this run was initiated, there was very little pressure drop across the reaction zone. Even after the plant had been in operation for 55 hours, the pressure drop across the reaction zone had increased very little. The plant was voluntarily shut down and an inspection of the reaction zone revealed freedom from deposits.

The results of these two runs are presented in Table II.

TABLE I

| Inspection of Reduced Crude Oil | |
|---|---|
| Gravity, °API | 6.5 |
| Distillation, °F. | |
| IBP | 636 |
| 10 | 781 |
| 20 | 856 |
| 30 | 938 |
| 35 | 985 |
| Heptane Insolubles, Vol. % | 16.8 |
| Metals Content, wt. ppm. | |
| Vanadium | 1400 |
| Nickel | 130 |
| Iron | 140 |

TABLE II

| Summary of the Example Results | | |
|---|---|---|
| Run | 1 | 2 |
| Temperature, °F. | 790 | 790 |
| Hydrogen Circulation Rate, SCFB | 5000 | 5000 |
| Liquid Hourly Space Velocity | 0.3 | 0.3 |
| Pressure, psig | 2000 | 2000 |
| Vanadium Sulfide Catalyst | | |
| Concentration, wt. % Vanadium | 4 | 4 |
| Solids Dispersant | No | Yes |
| Reaction Zone Pressure Drop | | |
| After 24 Hours, psi | ~300 | ~5 |

The foregoing specification and example clearly illustrate the improvement encompassed by the present invention and the benefits to be afforded an improved slurry process for the conversion of hydrocarbonaceous charge stocks.

We claim as our invention:

1. In a process for the conversion of an asphaltene-containing hydrocarbonaceous charge stock which comprises the steps of:

(a) forming a reactive slurry of said charge stock, hydrogen and a finely divided catalyst containing at least one metal component from the metals of Groups V-B, VI-B and VIII of the Periodic Table;

(b) reacting said slurry at hydrocarbon conversion conditions including a pressure above about 100 psig and a temperature above about 400° F.; and, (c) recovering a hydrocarbonaceous product; the improved method of reducing the formation of coke and other undesirable deposits in the process, which comprises effecting said reaction of the slurry in admixture with from about 0.0001% to about 1% by weight, based on the hydrocarbonaceous charge stock, of a solids dispersant comprising an oil-soluble HCl salt of the condensation product, formed at a temperature of from about 20° C. to about 150° C., of equimolar amounts of an epihalohydrin compound and an alkyl amine having from about 12 to about 40 carbon atoms per molecule, from about 1% to about 20% of the amino nitrogen in said condensation product being neutralized with HC1.

2. The process of claim 1 wherein said hydrocarbonaceous charge stock is derived from petroleum.

3. The process of claim 1 wherein said hydrocarbonaceous charge stock is a primary coal liquid.

4. The process of claim 1 wherein said hydrocarbonaceous charge stock is derived from oil shale.

5. The process of claim 1 wherein said hydrocarbonaceous charge stock is derived from tar sand.

6. The process of claim 1 wherein said metal component is vanadium.

7. The process of claim 1 wherein said metal component is molybdenum.

8. The process of claim 1 wherein said metal component is iron.

9. The process of claim 1 wherein said solids dispersant is a solution of the product of $C_{18}H_{37}NH(CH_2)_3NH_2$ which has been cross-linked with epichlorohydrin in a xylene solvent.

10. The process of claim 1 wherein said solids dispersant is the reaction product formed at a temperature of from about 20° C. to about 150° C., of from 1 to 2 mol proportions of an aliphatic amine compound having at least one hydrogen atom attached to a nitrogen atom, said amine compound consisting of carbon, hydrogen and nitrogen, and having at least 12 and up to about 40 carbon atoms and a straight chain of at least 3 carbon atoms attached to the nitrogen atom, with one mol proportion of an epihalohydrin compound selected from the group consisting of epichlorohydrin, 1,2-epi-4-chlorobutane, 2,3-epi-4-chlorobutane, 1,2-epi-5-chloropentane, 2,3-epi-5-chloropentane and corresponding bromo and iodo compounds, and reacting with an inorganic base to remove halogen.

11. The process of claim 1 wherein said solids dispersant is an oil-soluble HCl salt of the condensation product, formed at a temperature of from about 20° C. to about 150° C., of equimolar amounts of epichlorohydrin and tallow amine, from about 1% to about 20% of the amino nitrogen in said condensation product being neutralized with HCl.

12. The process of claim 1 wherein said solids dispersant is an oil-soluble HCl salt of an ester of carboxylic acid containing from about 6 to about 50 carbon atoms per molecule and the condensation product, formed at a temperature of from about 20° C. to about 150° C., of equimolar amounts of epichlorohydrin and an alkyl amine of from about 12 to about 40 carbon atoms per molecule, from about 1% to about 20% of the amino nitrogen in said condensation product being neutralized with HCl and the amount of carboxylic acid being sufficient to esterify from one to all of the hydroxyl groups in the condensation product.

13. The process of claim 1 wherein said solids dispersant is an oil-soluble mixed HCl-alkyl acid phosphate salt of the condensation product, formed at a temperature of from about 20° C. to about 150° C. of equimolar amounts of epichlorohydrin and an alkyl amine of from about 12 to about 40 carbon atoms per molecule, from about 1% to about 20% of the amino nitrogen in said condensation product being neutralized with HCl and the amount of alkyl acid phosphate being at least one mol of phosphate per mol of the condensation product.

14. The process of claim 1 wherein said solids dispersant is an oil-soluble alkyl acid phosphate salt of an ester of a carboxylic acid of from about 6 to about 50 carbon atoms per molecule and the condensation product of from 1 to 2 mols of an epihalohydrin compound with from 1 to 2 mols of an aliphatic amine of from about 12 to about 40 carbon atoms per molecule, the amount of said acid being sufficient to esterify from one to all of the hydroxyl groups in said condensation product and the amount of alkyl acid phosphate being at least one mol of phosphate per mol of the ester.

* * * * *